United States Patent [19]

Matsui

[11] 4,356,797

[45] Nov. 2, 1982

[54] SYSTEM FOR CONTROLLING AIR-FUEL RATIO

[75] Inventor: Fujio Matsui, Mitaka, Japan

[73] Assignees: Fuji Jukogyo Kabushiki Kaisha, Tokyo; Nissan Motor Co., Ltd., Yokohama, both of Japan

[21] Appl. No.: 174,377

[22] Filed: Aug. 1, 1980

[30] Foreign Application Priority Data

| | | | |
|---|---|---|---|
| Aug. 2, 1979 | [JP] | Japan | 54-98850 |
| Aug. 2, 1979 | [JP] | Japan | 54-98851 |
| Aug. 2, 1979 | [JP] | Japan | 54-98852 |

[51] Int. Cl.[3] ..... F02D 5/00

[52] U.S. Cl. ..... 123/440; 123/589

[58] Field of Search ..... 123/440, 589, 438, 437, 123/492, 493; 60/276, 285

[56] References Cited

U.S. PATENT DOCUMENTS

| | | | |
|---|---|---|---|
| 4,023,357 | 5/1977 | Masaki | 123/589 |
| 4,029,061 | 6/1977 | Asano | 123/440 |
| 4,171,690 | 10/1979 | Hosaka et al. | 123/440 |
| 4,187,812 | 2/1980 | Hosaka et al. | 123/440 |
| 4,237,839 | 12/1980 | Ueno et al. | 123/440 |

*Primary Examiner*—Raymond A. Nelli

*Attorney, Agent, or Firm*—Martin A. Farber

[57] ABSTRACT

A system for controlling the air-fuel ratio for a carburetor for an internal combustion engine having an intake passage, an exhaust passage, a throttle valve, a detector such as an oxygen sensor for detecting the concentration of oxygen in the exhaust gases, an air-fuel mixture supply device, an on-off electromagnetic valve for correcting the air-fuel ratio of the air-fuel mixture supplied by the air-fuel mixture supply device and an electric controller. A throttle sensor produces an output dependent on the operation of the throttle valve. The electric controller is so arranged as to decrease variation of controlled air-fuel ratio. The electric controller comprises a comparator for comparing the output signal of the detector with a set value, an integration circuit connected to the comparator, a middle value detecting circuit for detecting a middle value between peak values of the output of the integration circuit, a triangular wave pulse generator, and a comparing circuit for comparing the output of the middle value detecting circuit with the triangular wave pulse for producing square wave pulses for driving the on-off electromagnetic valve for controlling the air-fuel ratio to a value approximately equal to the stoichiometric air-fuel ratio. A correcting device compensates for the delay of the output of the middle value detecting circuit.

8 Claims, 15 Drawing Figures d
H
C
L

ELECTRONIC CONTROL CIRCUIT
THROTTLE SENSOR
1
2
3
4
5
6
7
8
9
10
11
12
13
14
15
16
17
18
19
20
21

SYSTEM FOR CONTROLLING AIR-FUEL RATIO

BACKGROUND OF THE INVENTION

The present invention relates to a system for controlling the air-fuel ratio of the air-fuel mixture for an internal combustion engine emission control system with a three-way catalyst, and more particularly to a system for controlling the air-fuel ratio of a value approximately equal to the stoichiometric air-fuel ratio for the air-fuel mixture so as to effectively operate the three-way catalyst.

Such a system as in U.S. Pat. No. 4,132,199 is a feedback control system, in which an oxygen sensor is provided to sense the oxygen content of the exhaust gases to generate an electrical signal as an indication of the air-fuel ratio of the air-fuel mixture supplied to the engine. The control system operates to compare the feedback signal from the oxygen sensor with a reference value corresponding to the stoichiometric value for producing the error signal and to control the air-fuel ratio of the mixture to be induced in the engine in accordance with the error signal.

Such a feedback control system inherently oscillates due to the detection delay of the oxygen sensor and the control delay in the system. The oscillation of the system causes the variation of the controlled air-fuel ratio relative to the stoichiometric value. Such a variation is increased during acceleration of the engine. Consequently, the emission control cannot accomplish a desired reduction of the harmful constituents of the exhaust gases.

SUMMARY OF THE INVENTION

The object of the present invention is to provide a system for controlling the air-fuel ratio which may decrease the variation of the air-fuel ratio relative to the stoichiometric value thereby bringing about the effective operation of the three-way catalyst.

According to the present invention, there is provided a system for controlling the air-fuel ratio for a carburetor of an internal combustion engine having an intake passage, an exhaust passage, a throttle valve, detecting means for detecting the concentration of a constituent of the gases passing through the exhaust passage, air-fuel mixture supply means, and an electromagnetic valve for correcting the air-fuel ratio of the air-fuel mixture supplied by the air-fuel mixture supply means, the system comprising:

a comparator for comparing the output signal of the detecting means with a reference value, an integration circuit for integrating the output of the comparator, a middle value detecting circuit for providing a plurality of middle values between two adjacent maximum and minimum values of the output of the integrating circuit, and a driving circuit for generating an output in dependency upon the output signal of the middle value detecting circuit for driving the electromagnetic valve, whereby the air-fuel ratio is controlled to a value substantially equal to the stoichiometric air-fuel ratio.

Other objects and features of the present invention will become apparent from the following description of preferred embodiments of the invention with reference to the accompanying drawings.

DETAILED DESCRIPTION OF THE PREFERRED EMBODIMENT

Figures 1, 2A:
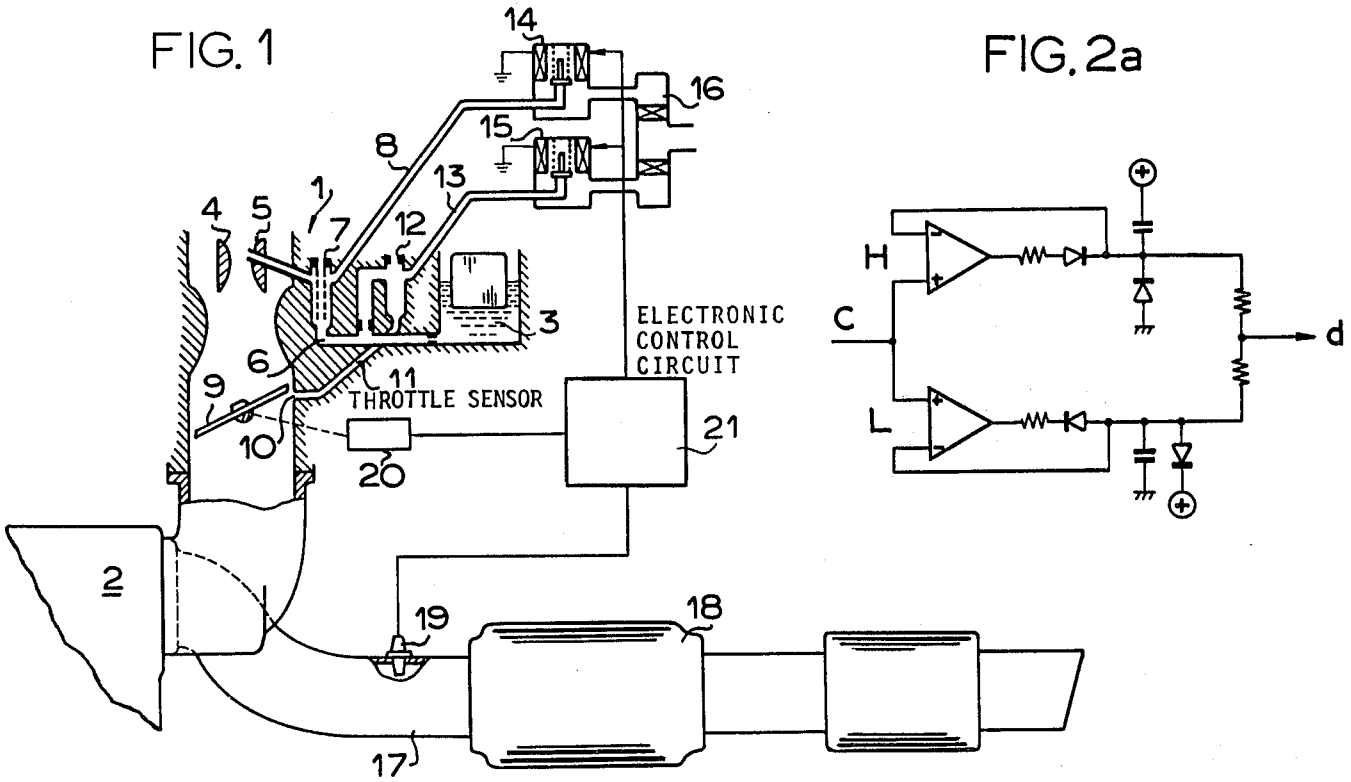
FIG. 1 is a schematic view of a system for controlling the air-fuel ratio according to the present invention.
FIG. 2*a* shows a middle value detecting circuit.

Referring to FIG. 1, a carburetor 1 communicates with an internal combustion engine 2. The carburetor comprises a float chamber 3, a venturi 4, a nozzle 5 communicating with the float chamber 3 through a main fuel passage 6, and a slow port 10 communicating with the float chamber 3 through a slow fuel passage 11. Air correcting passages 8 and 13 are provided in parallel to a main air bleed 7 and a slow air bleed 12, respectively. On-off type electromagnetic valves 14 and 15 are provided for the air correcting passages 8 and 13. An inlet port of each on-off type electromagnetic valve communicates with the atmosphere through an air cleaner 16. An oxygen sensor 19 is provided on an exhaust pipe 17 at the upstream side of a three-way catalyst converter 18 for detecting the oxygen content of the exhaust gases.

A throttle sensor 20 used in another embodiment of the invention is provided to detect the degree of opening of a throttle valve 9. Output signals of sensors 19 and 20 are sent to an electronic control circuit 21 for actuating the on-off type electromagnetic valves 14 and 15 to control the air-fuel ratio of the mixture to a value approximately equal to the stoichiometric air-fuel ratio.

Figure 2:
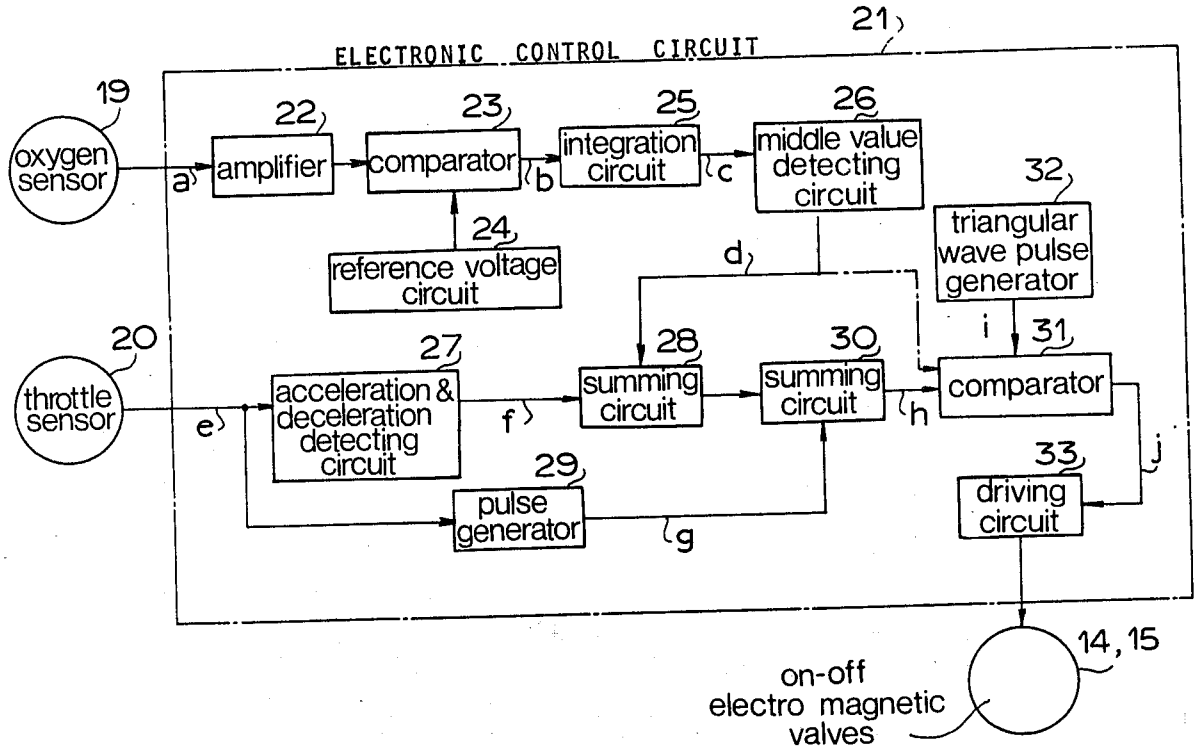
FIG. 2 is a block diagram of an electric control circuit according to the present invention.

Referring to FIG. 2, the output signal of the oxygen sensor 19 is fed to a comparator 23 through an amplifier 22. The comparator 23 operates to compare the input signal with a reference voltage applied from a reference voltage circuit 24 to produce an output higher or lower than the reference voltage. The output is sent to a middle value detecting circuit 26 through an integration circuit 25.

Figure 3:
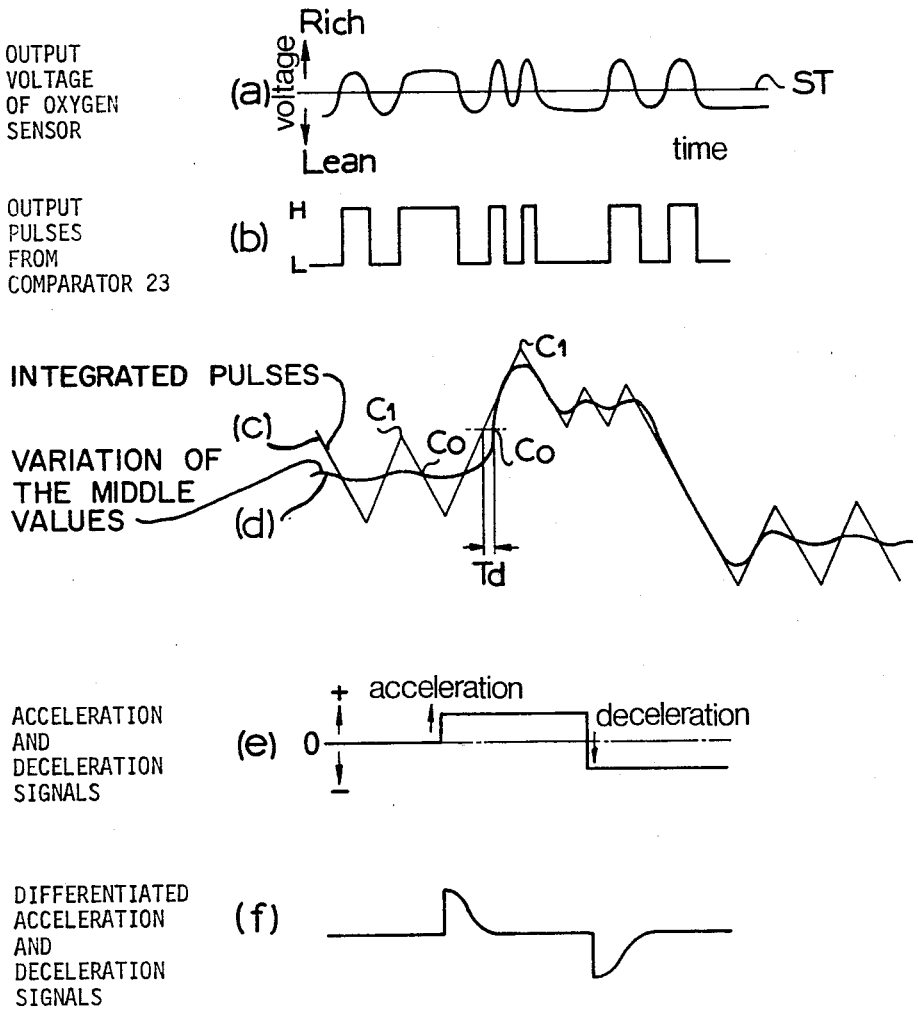
FIG. 3 shows waveforms at various portions in the circuit of FIG. 2.
Figure 3:
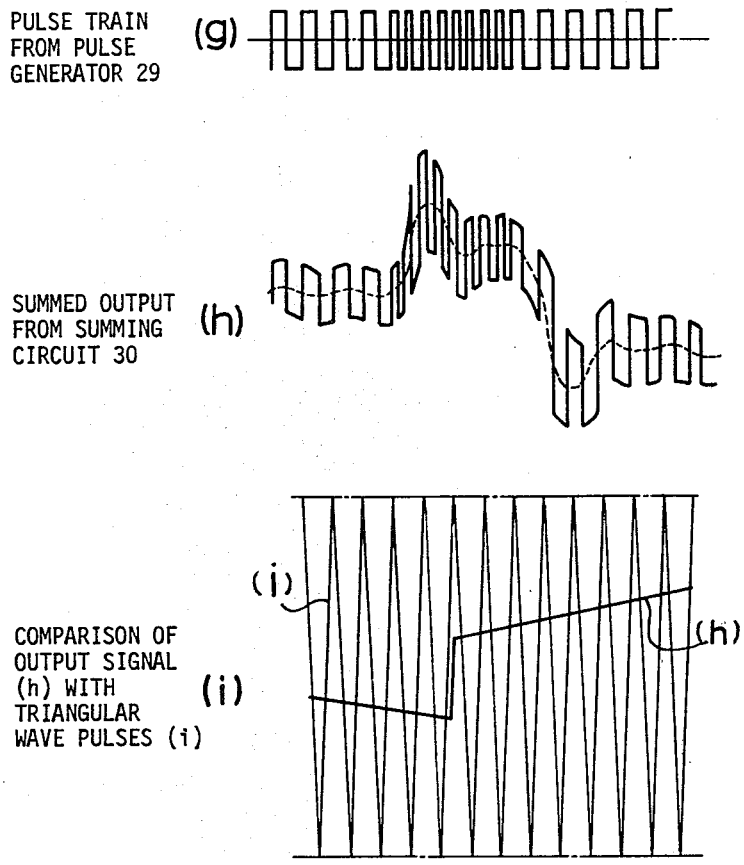

Explaining hereinafter the operation of the system with reference to FIG. 3 in waveforms (a) to (j) at points a to i in FIG. 2, the upper side of the stoichiometric air-fuel ratio line "ST" is for rich air-fuel mixtures and the lower side is for lean air-fuel mixtures. A high rise "R" (in FIG. 5(A)) of the exhaust gas constituent waveform occurs often upon acceleration of the engine because of the enrichment operation of the power device in the carburetor for the acceleration. The oxygen sensor 19 produces an output voltage changing as shown in FIG. 3(*a*) according to the variation of the air-fuel ratio of the mixture supplied into the engine. When the air-fuel mixture is rich, the output voltage of the sensor is at a higher level than the voltage corresponding to the stoichiometric value, and when the mixture is lean, the output voltage is at a lower level. The output signal of the oxygen sensor is fed to the comparator 23 through the amplifier 22. The comparator 23 compares the input signal with the level applied from the slice voltage applied from the reference voltage circuit 24 to produce pulses as shown in FIG. 3(*b*). The reference voltage is set to a value corresponding to the stoichiometric air-fuel ratio. The output pulses are integrated in the integration circuit 25 as shown in FIG. 3(*c*). The middle value detecting circuit 26 determines the middle value $C_0$ between the maximum and minimum voltages of each linear section $C_1$ of each integrated triangular wave $C_0$. FIG. 3(*d*) shows the variation of the middle values.

Figure 5:
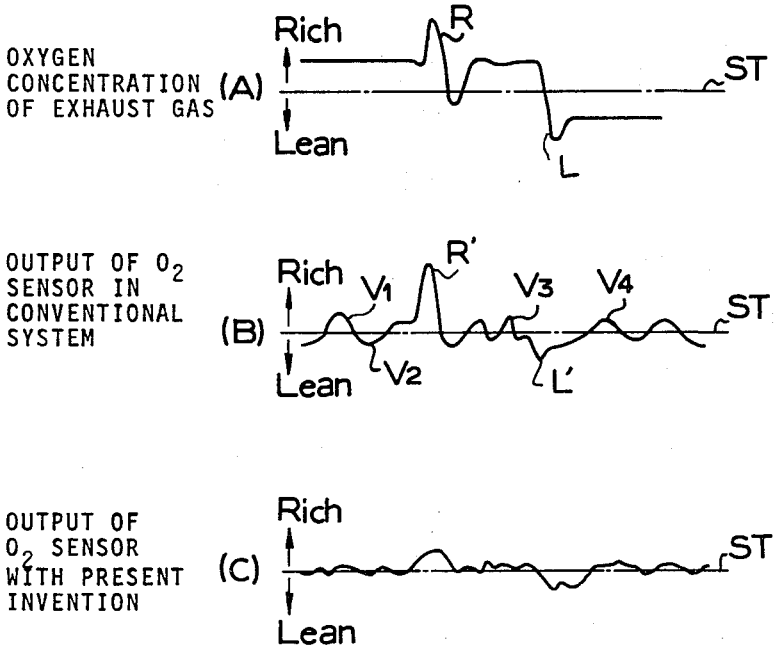
FIG. 5(A) shows an example of a waveform of the exhaust gas constituents.
FIG. 5(B) shows a waveform of the output of an oxygen sensor in a conventional system.
FIG. 5(C) shows a waveform of the output of an oxygen sensor in the system of the present invention.

In a conventional system, the output of the integration circuit 25 is fed directly to a comparator circuit 31, where it is compared with triangular wave pulses from a triangular wave pulse generator 32 for producing driving pulses. FIG. 5(A) shows an example of the variation of the oxygen concentration of the exhaust gases. FIG. 5(B) shows a corresponding variation of the output of the oxygen sensor in a conventional system. In other words, the air-fuel ratio of the mixture is controlled in dependency on the detected signal of FIG. 5(A) and the controlled mixture is combusted in the cylinder of the engine and the combustion gases are detected by the oxygen sensor 19. FIG. 5(B) shows the output of the sensor 19. From this figure, it will be seen that the deviation of the exhaust gas constituents of FIG. 5(A) is controlled in a range close to the stoichiometric value line ST as shown in FIG. 5(B). Nowever, it will be found that there are rich-lean variations $V_1$, $V_2$, $V_3$, $V_4$ which do not exist in the waveform of FIG. 5(A) and that large deviations R′ and L′ corresponding to deviations R and L in FIG. 5(A) remain in the waveform of FIG. 5(B). This is caused by the fact that the control is carried out with the output obtained by integrating the output of the comparator 23 which includes the large deviations R and L and that the variation of the integrated wave due to the large deviations causes the controlled air-fuel ratio to considerably vary. That is, the large deviations R and L do not converge rapidly, resulting in the production of the variations $V_1$ to $V_4$.

The present invention resolves such a problem by using the middle value between the maximum and minimum values of the integrated wave as a reference signal. More particularly, as shown by the dotted line in FIG. 2, the output of the middle value detecting circuit 26 as shown in FIG. 3(*d*) the comparator is fed to circuit 31 for controlling the electromagnetic valves 14 and 15. By such a system, it is possible for the air-fuel ratio to approach the stoichiometric value. Farther, it will also be seen that since the middle value $C_0$ is decided when the output voltage of the integration circuit 25 reaches a maximum value ($C_1$), the middle value signal ($C_0$) is generated after the output of the circuit actually reaches the middle value. This occurs particularly in acceleration operation. Such a delay is shown by "Td" in FIG. 3(*c*). This delay will cause the control delay. In addition, the acceleration causes a large rise "R" (FIG. 5(A)) of the exhaust gas constituent waveform which induces the variation of the controlled air-fuel ratio.

The present invention further provides means which may prevent the control delay and the induced variation caused by the acceleration of the engine. To this end, the throttle sensor 20 is provided.

The output signal of the throttle sensor 20 is fed to an acceleration and deceleration detecting circuit 27. The detecting circuit 27 is adapted to produce an output voltage in dependency upon the acceleration and deceleration of the throttle value.

The outputs of the circuits 26 and 27 are summed by a summing circuit 28. The output signal of the throttle sensor 20 is also sent to a pulse generator 29. The pulse generator 29 generates a pulse train having a pulse-repetition frequency dependent upon the opening degree and the angular acceleration and deceleration of the throttle valve 9 and the acceleration and decelerating duration. The outputs of the circuit 28 and 29 are fed to a summing circuit 30. The output signal of the circuit 30 is compared in the comparator circuit 31 with triangular wave pulses from the triangular wave pulse generator 32 for producing square wave pulses The output of the comparator circuit 31 is fed to the on-off type electromagnetic valves 14 and 15 via a driving circuit 33.

The throttle sensor 20 generates acceleration and deceleratio signals according to the operation of the engine as shown in FIG. 3(*e*). The signals are differentiated in the acceleration and deceleration detecting circuit 27 as shown in FIG. 3(*f*). The output (f) of the circuit 27 is added to the output (d) of the circuit 26 by the summing circuit 28. The differentiated signal of FIG. 3(*f*) is generated before the middle value signal from the circuit 26. Thus, the delay "Td" of the detected middle value is compensated by adding the differentiated signal. On the other hand, the pulse generator 29 generates a pulse train (g), the pulse-repetition frequency of which varies according to the degree of opening and the angular acceleration and deceleration of the throttle valve 9 and the acceleration and deceleration duration. The frequency increases with the increase of the angular acceleration and deceleration. FIG. 3(*g*) shows the repetition frequency according to the acceleration and deceleration of FIG. 3(*e*). The pulse train of FIG. 3(*g*) is added to the corrected middle value output signal of the circuit 28 by the summing circuit 30. Thus, the corrected middle value output is converted into a pulse train as shown in FIG. 3(h) and the pulse-repetition frequency during a period according to the acceleration and deceleration of FIG. 3(*e*) increases.

The (h) output of the summing circuit 30 is compared with the triangular wave pulses from the pulse generator 32 in the comparator circuit 31. As shown in FIG. 3(*i*) and FIG. 4, the output signal (h) is compared with and slices the triangular wave pulses (i), so that output pulses (j) are produced. The output pulses are fed to the on-off type electromagnetic valves 14 and 15 through the driving circuit 33 to actuate the valves.

Figure 4:
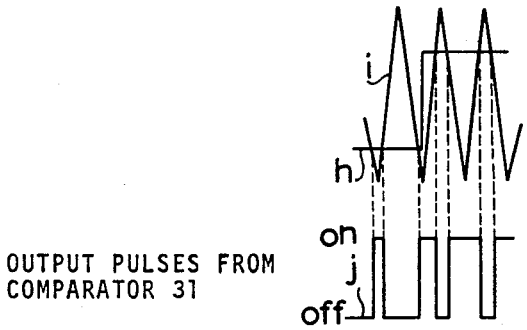
FIG. 4 shows wave forms for explaining the operation of a comparator in FIG. 2.

From FIG. 4, it will be seen that when the level of the signal (h) is high, a pulse having a greater pulse duty ratio is produced. Thus, when a rich air-fuel ratio is detected, the opening duration of the valves 14 and 15 is increased so that a lean air-fuel mixture may be supplied to the engine. When the engine is accelerated or decelerated, the pulse-repetition frequency of the output pulse (j) is increased. Thus, the response of the control system may be quickened, so that the variation of the air-fuel ratio can be decreased. Further, the control delay due to the acceleration or deceleration can be corrected. FIG. 5(C) shows the variation of the air-fuel ratio in the control system of the present invention, in which the air-fuel ratio is controlled to a small range relative to the stoichiometric air-fuel ratio.

From the foregoing, it will be observed that, in the feedback control system of the present invention, the feedback signal from the oxygen sensor is compared with the desired reference value to produce the error signal, and the error signal is integrated and, middle values between maximum and minimum values of the integrated wave are detected, and the middle values are converted into a driving signal for driving the electromagnetic valve. Thus, the variation of the controlled air-fuel ratio can be decreased.

Further, in accordance with the present invention, the control delay caused by acceleration can be corrected by compensation with the differentiated signal, and the response may be quickened by increasing the pulse-repetition frequency of the driving pulse.

What is claimed is:

1. In a system for controlling an air-fuel ratio for a carburetor of an internal combustion engine having an intake passage, an exhaust passage, a throttle valve, detecting means for detecting the concentration of a constituent of exhaust gases passing through said exhaust passage, air-fuel mixture supply means for supplying to the intake passage, and electromagnetic valve for correcting the air-fuel ratio of the air-fuel mixture supplied by said air-fuel mixture supply means, the improvement comprising:

a comparator means for comparing the output signal of said detecting means with a reference value, integration circuit means for integrating the output of said comparator means, middle value detecting circuit means for providing a plurality of middle values between adjacent two maximum and minimum values of the output of said integration circuit, and driving circuit means for generating an output in dependency upon the output signal of said middle value detecting circuit means for driving said electromagnetic valve means, whereby the air-fuel ratio is controlled to a value substantially equal to stoichiometric air-fuel ratio.

2. A system for controlling an air-fuel ratio for a carburetor of an internal combustion engine having an intake passage, an exhaust passage, a throttle valve, detecting means for detecting the concentration of a constituent of gases passing through said exhaust passage, air-fuel mixture supply means, and electromagnetic valve means for correcting the air-fuel ratio of the air-fuel mixture supplied by said air-fuel mixture supply means, the improvement comprising:

comparator means for comparing the output signal of said detecting means with a reference value, an integration circuit means for integrating the output of said comparator means, a middle value detecting circuit means for detecting a middle value between peak values of the output of said integration circuit means, throttle sensor means for producing an output signal dependent upon the operation of said throttle valve, acceleration and deceleration detecting means for differentiating the output of said throttle sensor means, summing circuit means for summing said outputs of said middle value detecting circuit means and said acceleration and deceleration detecting circuit means, driving circuit means for generating an output in dependency on the output signal of said summing circuit means for driving said electromagnetic valve means, whereby the air-fuel ratio is controlled to a value substantially equal to the stoichiometric air-fuel ratio.

3. The system as set forth in claim 2 wherein said electromagnetic valve means constitutes an on-off type electromagnetic valve for correcting the air-fuel ratio of the air-fuel mixture supplied by said air-fuel mixture supply means, said driving circuit means comprises a triangular wave pulse generator and means for comparing the output of said summing circuit means with triangular pulses from said triangular wave pulse generator so as to produce square wave pulses to drive said on-off type electromagnetic valve.

4. A system for controlling an air-fuel ratio for a carburetor of an internal combustion engine having an intake passage, an exhaust passage, a throttle valve, detecting means for detecting the concentration of a constituent of gases passing through said exhaust passage, air-fuel mixture supply means, and an on-off electromagnetic valve means for correcting the air-fuel ratio of the air-fuel mixture supplied by said air-fuel mixture supply means, the improvement comprising:

comparator means for comparing the output signal of said detecting means with a reference value, integration circuit means for integrating the output of said comparator means, a middle value detecting circuit means for detecting a plurality of middle values between two adjacent maximum and minimum values of the output of said integration circuit means, and throttle sensor means for producing an output signal dependent upon the operation of said throttle valve, acceleration and deceleration detecting circuit means for differentiating the output of said throttle sensor means, pulse generator means for generating a pulse train having pulse-repetition frequency varying in dependency on the output signal of said throttle sensor means, summing circuit means for summing the output of said middle value detecting circuit means and the output of said acceleration and deceleration detecting circuit means and the output of said pulse generator means, a triangular wave pulse generator, and comparing circuit means for comparing the output of said summing circuit means with triangular pulses from said triangular wave pulse generator for producing pulses driving said on-off electromagnetic valve.

5. The system as set forth in claim 1, wherein said middle value detecting circuit means generates one of said middle values between adjacent two of said peaks when the last of said two peaks is reached.

6. The system as set forth in claim 1, wherein said middle value detecting circuit means comprises two operational amplifiers each having commonly connected positive inputs connected to the output of said integration circuit means and outputs, respectively, oppositely poled first diodes are connected to the respective outputs of said operational amplifiers, said operational amplifiers have negative inputs respectively fed back to a junction across said diodes, respectively, a resistor bridge connects said junctions and a point intermediate said resistor bridge constitutes the output of said middle value detecting circuit means, a second diode and a first capacitor are connected respectively from ground to a voltage source and a common point thereof is connected to one of said junctions, both said second diode and one of said first diodes are poled in a first common direction with respect to said one junction, a third diode and a second capacitor are connected respectively from the voltage source to ground and a common point thereof is connected to the other of said junctions, both said third diode and the other of said first diodes are poled in a second common direction with respect to said other junction.

7. The system as set forth in claim 4, wherein said pulse generator means for generating a pulse train having pulse-repetition frequency which increases during acceleration and deceleration respectively.

8. The system as set forth in claim 4, wherein said pulse generator means for generating a pulse train having pulse-repetition frequency which varies according to the degree of opening and the angular acceleration and deceleration of the throttle valve and the acceleration and deceleration duration.

* * * * *